US006695441B2

(12) United States Patent
Asano

(10) Patent No.: US 6,695,441 B2
(45) Date of Patent: Feb. 24, 2004

(54) INKJET DEVICE INCLUDING ULTRASONIC VIBRATOR FOR APPLYING ULTRASONIC VIBRATION TO INK

(75) Inventor: Takeshi Asano, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/202,840

(22) Filed: Jul. 26, 2002

(65) Prior Publication Data

US 2003/0020788 A1 Jan. 30, 2003

(30) Foreign Application Priority Data

Jul. 27, 2001 (JP) ..... 2001-228151

(51) Int. Cl.[7] ..... B41J 2/175

(52) U.S. Cl. ..... 347/86; 347/19

(58) Field of Search ..... 347/85, 86, 14, 347/19, 20, 27

(56) References Cited

U.S. PATENT DOCUMENTS 4,323,908 A * 4/1982 Lee et al. ..... 347/27
5,757,392 A * 5/1998 Zhang ..... 347/14
6,059,405 A * 5/2000 Mochizuki et al. ..... 347/92

* cited by examiner

*Primary Examiner*—Anh T. N. Vo
(74) *Attorney, Agent, or Firm*—Oliff & Berridge, PLC

(57) ABSTRACT

An ink tank 40 is placed on an ultrasonic vibrator 32. When a certain condition is established, such as when the print head 14 is exchanged, then the ultrasonic vibrator 32 generates ultrasonic vibration in ink stored in the ink tank 40. The ultrasonic vibration disperses cohered or settled-out pigments throughout the ink when a pigment-based ink is used, or breaks up any molecular binding to reduce the molecular-weight distribution when polymeric ink is used.

16 Claims, 11 Drawing Sheets

INKJET DEVICE INCLUDING ULTRASONIC VIBRATOR FOR APPLYING ULTRASONIC VIBRATION TO INK

BACKGROUND OF THE INVENTION

1. Field of the Invention

The present invention relates to an inkjet device capable of preventing cohesion and sedimentation of ink in an ink reservoir.

2. Related Art

There has been known an inkjet printer that includes an inkjet head formed with a plurality of nozzles through which ink droplets are ejected onto a recording medium to form images thereon. There are also provided various types of inks, including dye-based inks, pigment-based inks, and polymeric inks, that can be used in such an inkjet printer. Pigment-based inks have a problem in that the pigments in the ink can easily cohere with each other or settle out from the liquid base. Polymeric inks have a problem in that over time the molecular-weight distribution can increase because of molecular coupling. When these problems arise, printing results can be erratic and the ink nozzles can become clogged.

In order to overcome these problems, there has been proposed to provide stirrer bares, such as magnetic stirrers, that a main unit can drive without contact the same, in the ink tank of inkjet printers in order to agitate the ink in the ink tank.

However, merely stirring up the ink does not sufficiently disperse pigments and molecular materials, so that problems, such as pigment sedimentation and cohesion, cannot be completely solved.

SUMMARY OF THE INVENTION

It is an object of the present invention to overcome the above-described problems and to provide an inkjet device capable of preventing problems, such as pigment sedimentation, and pigment cohesion, and increase in molecular-weight distribution.

In order to overcome the above and other objects, there is provided an inkjet device including an inkjet head that ejects ink droplets, an ink reservoir that holds ink, an ultrasonic vibration unit that applies ultrasonic vibration to the ink in the ink reservoir, a condition judgment unit that judges whether a certain condition is established, and a vibration control unit that, when the condition judgment unit judges that the certain condition is established, controls the ultrasonic vibration unit to apply ultrasonic vibration to the ink.

DETAILED DESCRIPTION OF THE EMBODIMENTS

Next, inkjet printers according to embodiments of the present invention will be described with reference to the attached drawings.

Figure 1:
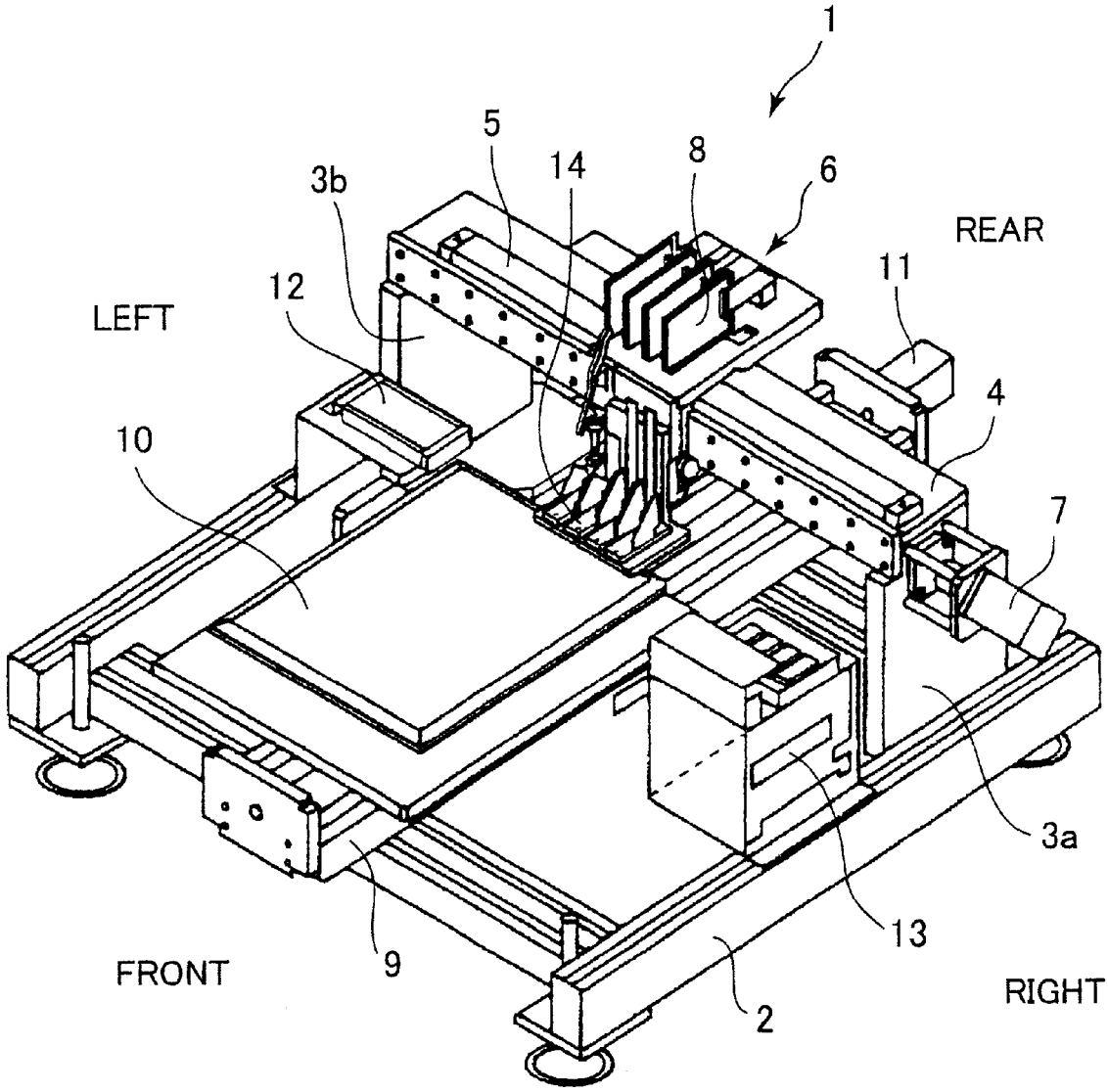
FIG. 1 is a perspective view showing an inkjet printer according to a first embodiment of the present invention.

First, an inkjet printer 1 according to a first embodiment of the present invention will be described. As shown in FIG. 1, the inkjet printer 1 includes a base frame 2, support frames 3*a*, 3*b*, an X-axis frame 4, and a linear scale 5. The base frame 2 is formed in a substantially rectangular shape, and the support frames 3*a*, 3*b* are disposed with an upright posture on a rear end of the base frame 2. The X-axis frame 4 spans between the support frames 3*a* and 3*b*. The linear scale 5 configures the X-axis of the X-axis frame 4.

A carriage 6 is mounted on the linear scalar 5, and supports print heads 14 and drive circuit boards 8. Each drive circuit board 8 drives a corresponding print head 14 to eject one of four colors of ink: black, magenta, cyan, and yellow. An X-axis motor 7 is provided on a right end of the X-axis frame 4 for driving the carriage 6 to slidingly move reciprocally across the linear scalar 5 in the lengthwise direction of the linear scalar 5.

A Y-axis frame 9 is disposed on the base frame 2 so as to extend perpendicular to the X-axis frame 4. A platen 10 having a substantially rectangular flat shape is provided on the Y-axis frame 9. A Y-axis motor 11 is provided on a rear end of the Y-axis frame 9 for driving the platen 10 to reciprocally move in the lengthwise direction of the Y-axis frame 9. Provided at the left-hand side of the base frame 2 is a flushing position 12 where flushing operations are performed. During flushing operations, ink is ejected from the print heads 14 to remove nozzle clogs. A maintenance unit 13 is provided on the right-hand side of the base frame 2. The maintenance unit 13 performs suction or purging operations for removing ink from the nozzle of the print heads 14 and wiper operations for wiping off a nozzle surface of the print heads 14.

Figure 2:
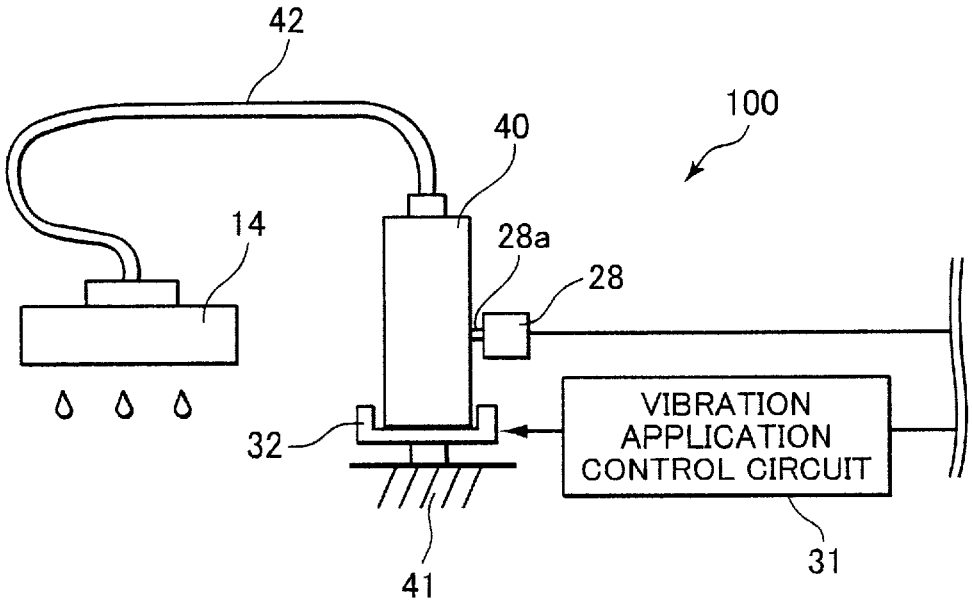
FIG. 2 is a schematic view showing an ink supply mechanism of the inkjet printer shown in FIG. 1.

The inkjet printer 1 further includes ink supply mechanisms 100 shown in FIG. 2. Although the inkjet printer 1 includes four ink supply mechanisms 100 each for corresponding one of the print head 4, only one ink supply mechanism 100 will be described in order to simplify the explanation.

As shown in FIG. 2, the ink supply mechanism 100 includes a cylindrical ink tank 40, a base 41, an ink tube 42, a vibration application control circuit 31, an ultrasonic vibrator 32, and an ink tank exchange detection circuit 28. The ultrasonic vibrator 32 is a 500W to 1,000 W ultrasonic Langevin transducer, for example, and fixed to the base 41. The ink tank 40 is mounted on the ultrasonic vibrator 32 and connected to the print head 14 through the ink tube 42. The ink tank exchange detection circuit 28 includes a sensor 28*a*, which abuts against the ink tank 40 and detects detachment and attachment of the ink tank 40. The ink tank exchange detection circuit 28 could be a well-know microswitch, for example. The vibration application control circuit 31 is connected to the ultrasonic vibrator 32.

Figure 3:
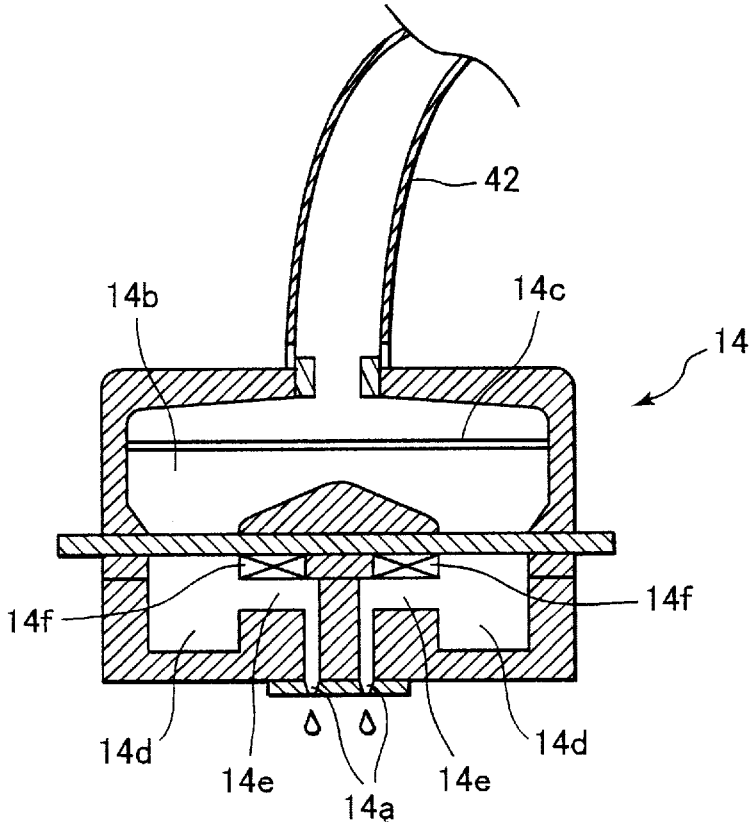
FIG. 3 is a cross-sectional view of a print head of the inkjet printer shown in FIG. 1.

FIG. 3 shows an internal configuration of the print head 14. As shown in FIG. 3, the print head 14 is formed with a plurality of nozzles 14*a*, an internal ink chamber 14*b*, a pair of manifolds 14*d*, and a plurality of cavities 14*e*. The ink tube 42 is connected to the ink chamber 14*b*. An ink filter 14*c* is provided in the ink chamber 14*b*. With this configuration, ink in the ink tank 40 is supplied through the ink tube 42, the ink chamber 14*b*, the manifolds 14, to the nozzles 14*a*. Piezoelectric elements 14*f* are provided inside the cavities 14*e* for applying pressure to the ink filling the corresponding cavities 14*e* so as to eject ink droplets through the nozzles 14*a* onto a recording medium. The recording medium can be paper, cloth, glass plate, plastic plate, and the like. In the present embodiment, either a pigment-based ink or a polymeric ink can be used.

Figure 4:
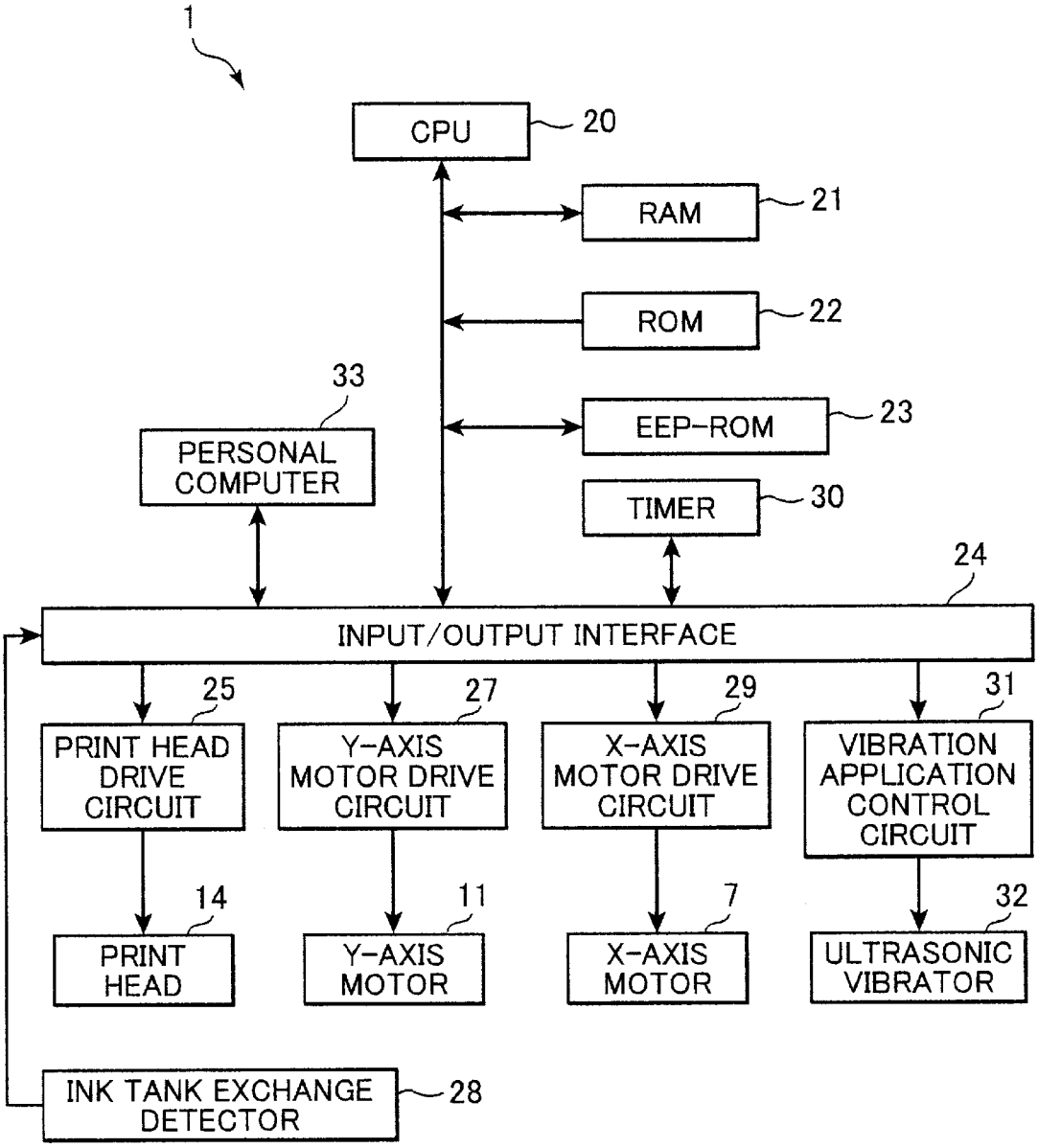
FIG. 4 is a block diagram showing electrical configuration of the inkjet printer of FIG. 1.

Next, the electrical configuration of the inkjet printer 1 will be described while referring to FIG. 4. As shown in FIG. 4, the inkjet printer 1 includes a central processing unit (CPU) 20 for controlling the inkjet printer 1. A random access memory (RAM) 21, a read only memory (ROM) 22, an electrically erasable programmable read-only memory (EEPROM) 23, and an input/output interface 24 are connected to the CPU 20. The RAM 21 stores a variety of data, such as print data. The ROM 22 stores programs that are executed by the CPU 20. The EEPROM 23 stores settings of the functions of the inkjet printer 1.

The input/output interface 24 is connected to a print head drive circuit 25, a Y-axis motor drive circuit 27, an X-axis motor drive circuit 29, a timer 30, a vibration application control circuit 31, and the ink tank exchange detection circuit 28. The print head drive circuit 25, the Y-axis motor drive circuit 27, and the X-axis motor drive circuit 29 are for driving the print heads 14, the Y-axis motor 11, and the X-axis motor 7, respectively. The vibration application control circuit 31 is for controlling the ultrasonic vibrator 32. The ink tank exchange detection circuit 28 is for detecting exchange of the ink tank 40. The input/output interface 24 is also connected to a personal computer 33.

Figure 5:
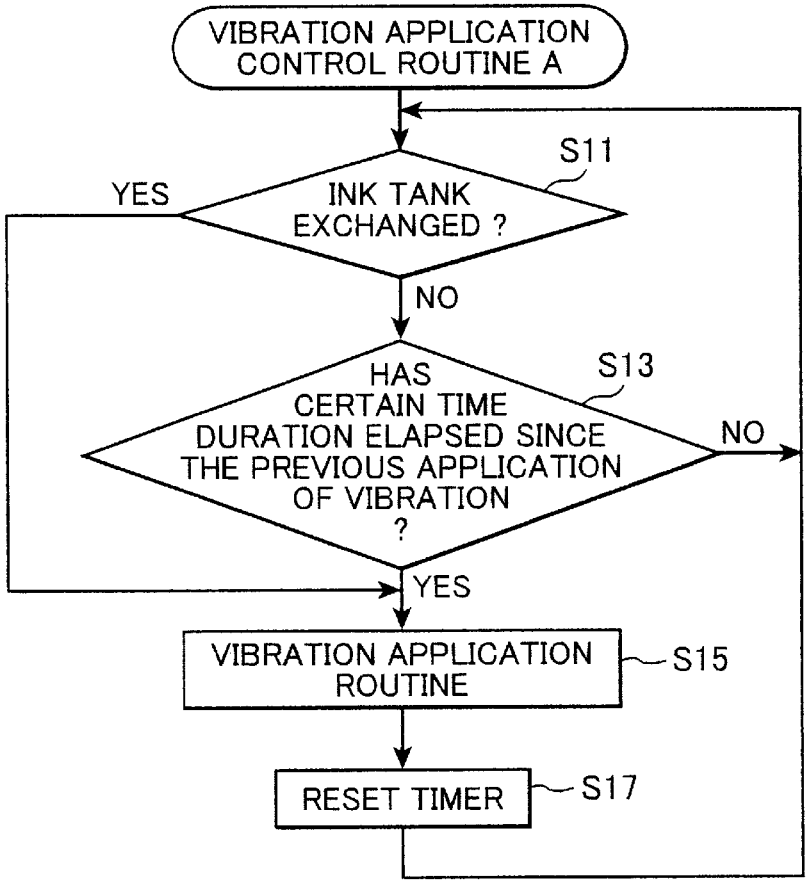
FIG. 5 is a flowchart representing a vibration application process A executed in the inkjet printer of FIG. 1.

Next, a vibration application control routine A performed in the inkjet printer 1 will be describe with reference to the flowchart of FIG. 5. When the ink tank exchange detection circuit 28 detects that the ink tank 40 was exchanged (S11:YES), then in S15 a vibration application routine is executed. In the vibration application routine, first the CPU 20 transmits a vibration application command to the vibration application control circuit 31 through the input/output interface 24. In response to the vibration application command, the vibration application control circuit 31 controls the ultrasonic vibrator 32 to generate ultrasonic vibration for about 10 minutes so as to apply the ultrasonic vibration to the ink in the ink tank 40. As a result, when a pigment-based ink is used in the inkjet printer 1, then any cohered or settled out pigments are dispersed throughout the ink in the ink tank 40. When a polymeric ink is used in the inkjet printer 1, then the ultrasonic vibration breaks up any molecular binding so that the molecular-weight distribution is reduced. Then, the routine proceeds to S17 where the timer 30 is reset and starts measuring a time duration, and the routine returns to S11.

If the ink tank exchange detection circuit 28 does not detect that the ink tank 40 is exchanged (S11:NO), then it is determined in S13 whether or not the timer 30 has measured a certain duration of time, such as six hours or eight hours. If not (S13:NO), then the routine returns to S11. On the other hand, if so (S13:YES), then the routine proceeds to S15.

As described above, by applying an ultrasonic vibration to the ink when the ink tank 40 is exchanged or when a certain time duration has elapsed without the ink tank 40 being exchanged, pigment sedimentation and cohesion in pigment-based ink or increase in molecular-weight distribution in polymeric ink is prevented, so that high printing results can be obtained while avoiding clogging in the nozzles.

Figure 6:
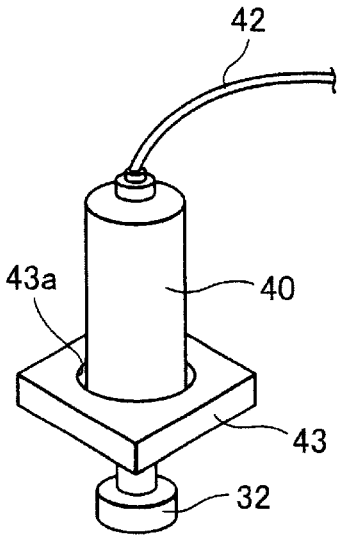
FIG. 6 is a perspective view showing an ink supply mechanism according to a first modification of the first embodiment.
Figure 7:
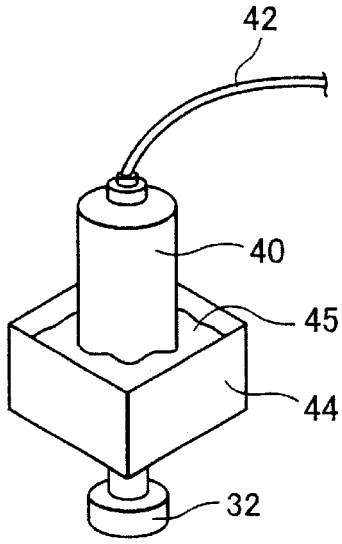
FIG. 7 is a perspective view showing an ink supply mechanism according to a second modification of the first embodiment.

FIGS. 6 and 7 shows modifications of the first embodiment of the present invention. In the first modification shown in FIG. 6, a platform 43 formed with an indentation 43*a* is fixed on the ultrasonic vibrator 32. The ink tank 40 is mounted in the indentation 43*a*, which is slightly larger than the outer periphery of the ink tank 40. In the second modification shown in FIG. 7, a liquid holding vessel 44 is fixed on the ultrasonic vibrator 32. The liquid holding vessel 44 is filled with a liquid 45 such as water. The ink tank 40 is placed in the liquid holding vessel 44 in the liquid 45. With these configurations, the ultrasonic vibration from the ultrasonic vibrator 32 can be better transmitted to the ink in the ink tank 40.

Figure 8:
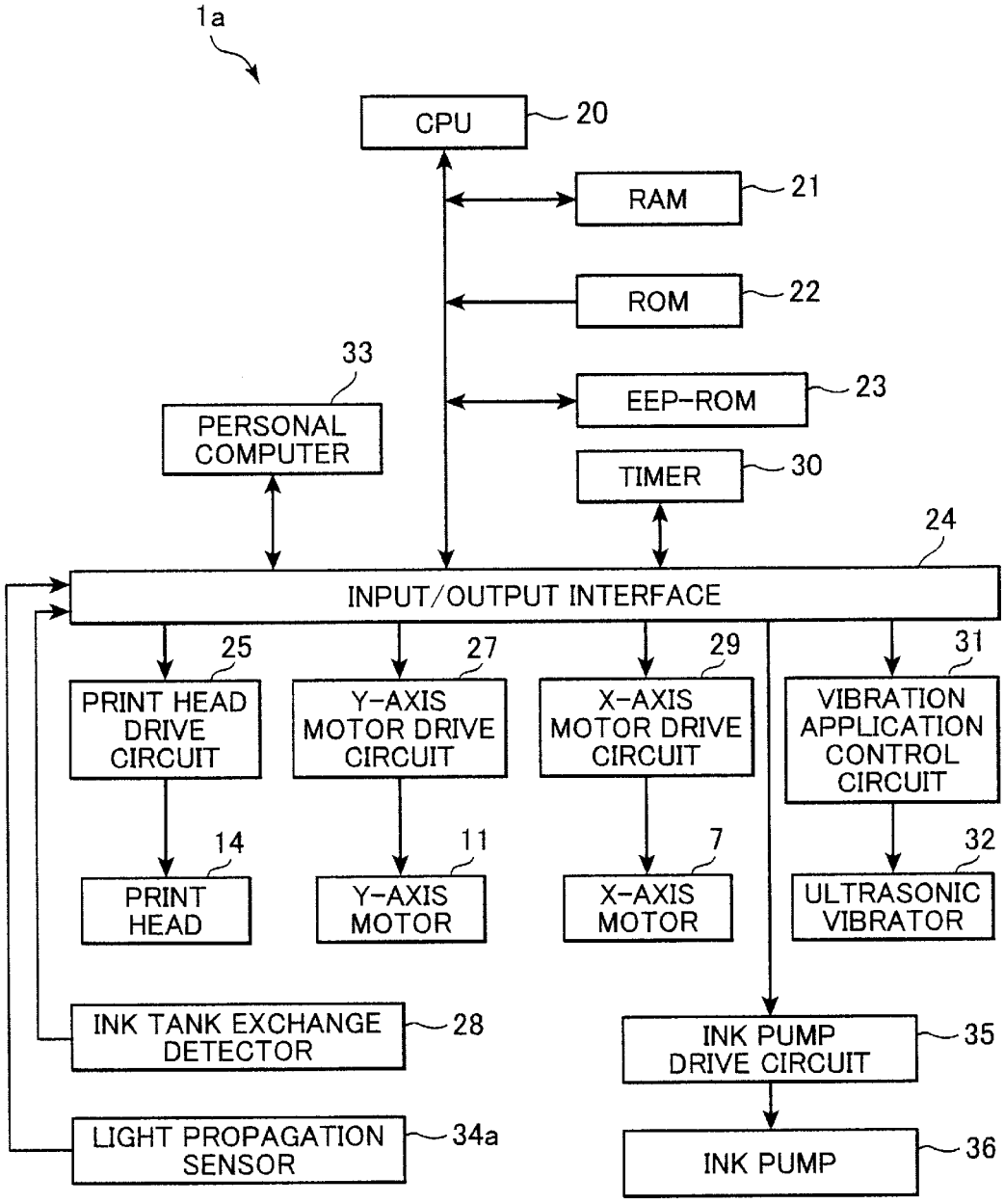
FIG. 8 a block diagram showing electrical configuration of an inkjet printer according to a second embodiment of the present invention.

Next, an inkjet printer la according a second embodiment of the present invention will be described with reference to FIGS. 8 to 10. The components similar to those of the first embodiment will be assigned with the same numberings and their explanation will be omitted.

Figure 9:
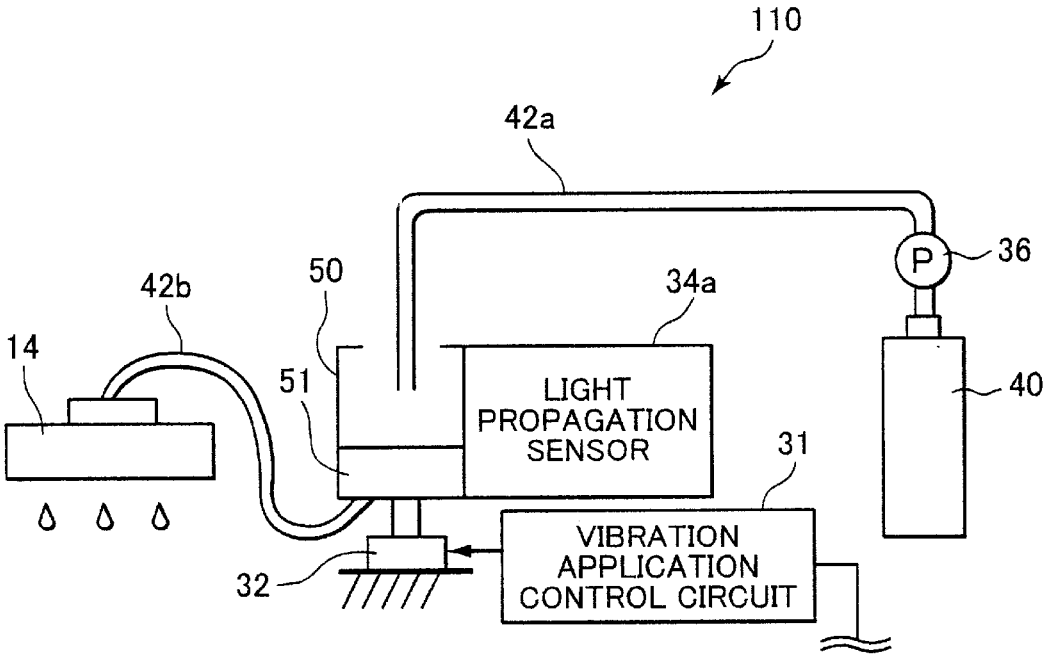
FIG. 9 is a schematic view showing an ink supply mechanism of the inkjet printer according to the second embodiment of the present invention.
Figure 10:
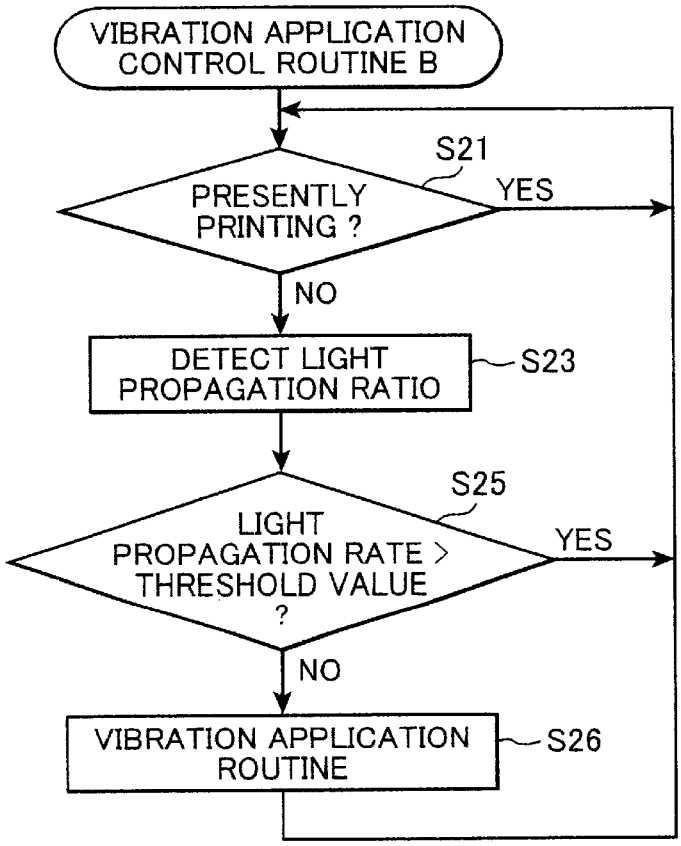
FIG. 10 is a flowchart representing a vibration application process B executed by the inkjet printer according to the second embodiment of the present invention.

The inkjet printer la is similar to the inkjet printer 1 of the first embodiment, except that as shown in FIG. 9 the inkjet printer la includes an ink supply mechanism 110 instead of the ink supply mechanism 100. The ink supply mechanism 110 includes a light propagation sensor 34*a*, a vibration application control circuit 31, an ultrasonic vibrator 32, an ink pump 36, an ink tank 40, and a sub tank 50. The sub tank 50 is mounted on the carriage 6 and reciprocally moved along with the print head 14. The ink pump 36 is located near the ink tank 40 and supplies ink 51 through an ink tube 42*a* from the ink tank 40 into the into the sub tank 50. The ink 51 housed in the sub tank 50 is further supplied to the print head 14 through an ink tube 42*b*. In the present embodiment, a pigment-based ink is used as the ink 51. The ink pump 36 is connected to the input/output interface 24 via an ink pump drive circuit 35 (FIG. 8).

The light propagation sensor 34*a* is provided in the sub tank 50 and includes a semi-conductor laser and a photo diode (not shown). The light propagation sensor 34*a* serves as an ink state detector and detects a light propagation rate in the ink 51. The ultrasonic vibrator 32 is provided at the bottom of the sub tank 50 and connected to the vibration application control circuit 31. As shown in FIG. 8, the light propagation sensor 34*a* is connected to the input/output interface 24.

Next, a vibration application control routine B performed according to the second embodiment will be described while referring to the flowchart in FIG. 10. First, it is determined in S21 whether or not the print head 14 is presently being used to print. If not (S21:NO), then in S23 the light propagation sensor 34*a* detects a light propagation rate of the ink 51 inside the sub tank 50, and in S25 it is determined whether or not if the detected light propagation rate is greater than a predetermined threshold value. This determination can be made using a well-known dynamic light scattering method, such as Doppler scattered light analysis. If the detected light propagation rate is equal to or lower than the predetermined threshold value (S25:NO), then this means that pigments in the ink 51 have cohered or settled out, so that a vibration application routine is executed in S26. In this vibration application routine, first the CPU 20 transmits a vibration application command to the vibration application control circuit 31. Upon reception of the vibration application command, the vibration application control circuit 31 controls the ultrasonic vibrator 32 to generate ultrasonic vibration at a frequency of several ten thousand kHz for about 10 minutes so as to apply the ultrasonic vibration to the ink 51 in the sub tank 50. As a result, any cohered or settled out pigments are dispersed throughout the ink 51.

On the other hand, if the detected light propagation rate is greater than the predetermined threshold value (S25:YES), then this means that pigments in the ink 51 have not cohered or settled out, so that the routine returns to S21.

If an affirmative determination results in S21 (S21:YES), then the routine waits until the negative determination is made in S21. This is because the ultrasonic vibration generated during the printing will adversely affect printing since the sub tank 50 to which the ultrasonic vibrator 32 is provided is located near the print head 14.

As described above, according to the present embodiment, when cohered or settled out pigments in the ink are detected, then ultrasonic vibration is generated to disperse cohered or settled-out pigments throughout the ink. Accordingly, clogging in the nozzles can be avoided, and high quality image can be provided.

Next, an inkjet printer 1*b* according to a third embodiment of the present invention will be described while referring to FIGS. 11 to 13. The inkjet printer 1*b* is similar to the inkjet printers 1 and 1*a* of the first and second embodiments, except that the inkjet printer 1*b* includes an ink supply mechanism 120 shown in FIG. 12 instead of the ink supply mechanism 100, 110. In the present embodiment, a pigment-based ink is used.

Figure 11:
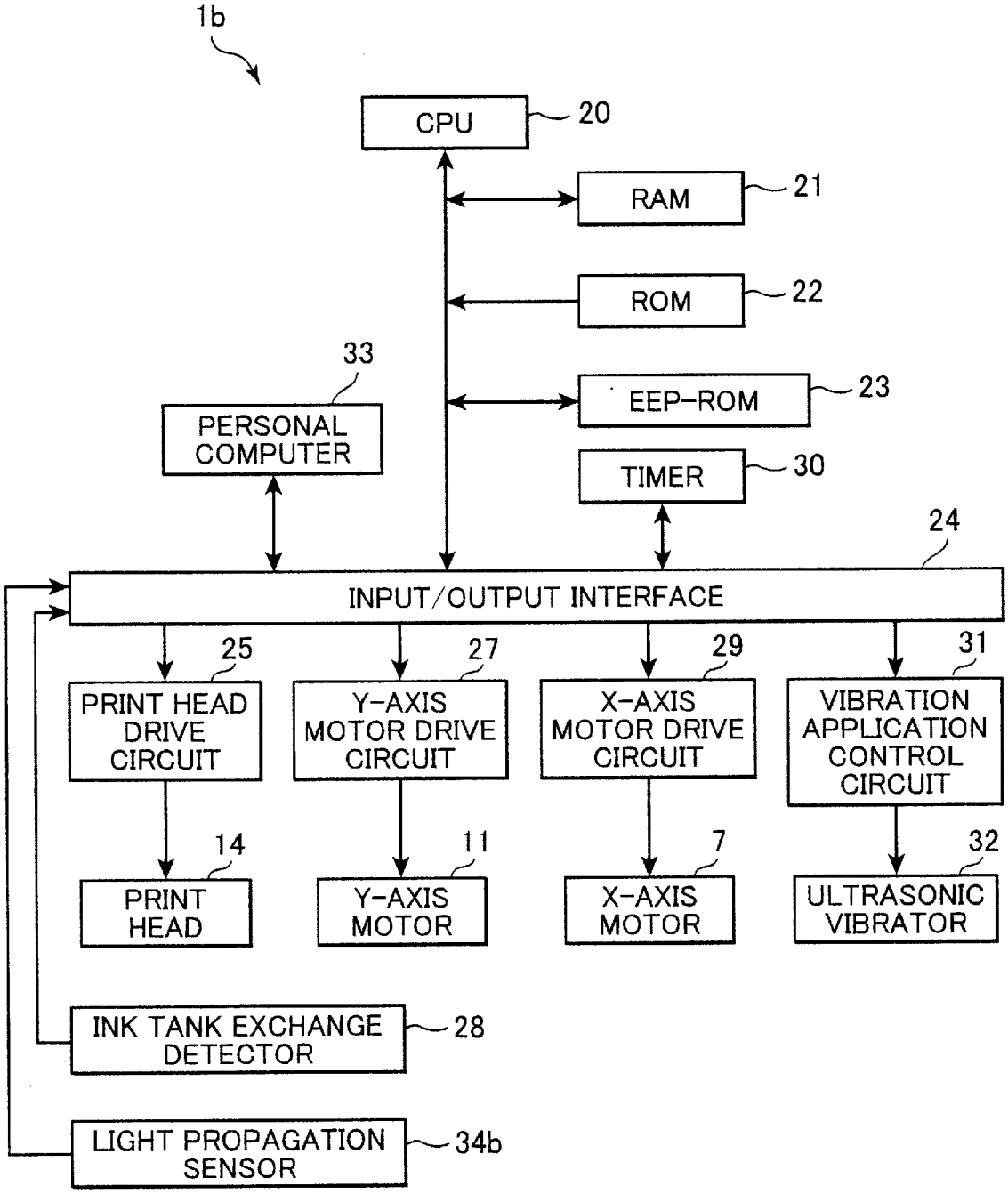
FIG. 11 a block diagram showing electrical configuration of an inkjet printer according to a third embodiment of the present invention.
Figure 12:
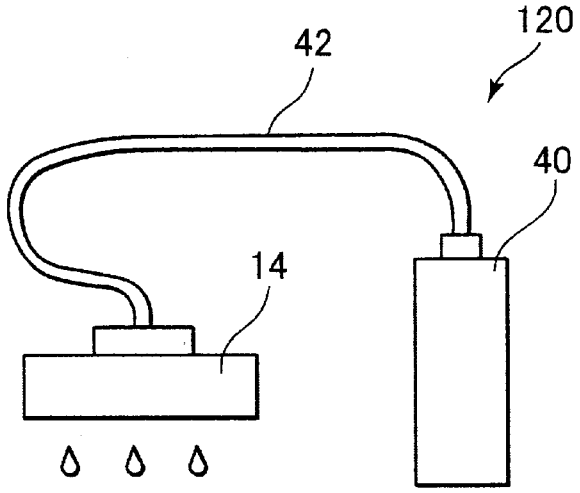
FIG. 12 is a schematic view showing an ink supply mechanism of the inkjet printer according to the third embodiment of the present invention.
Figure 13:
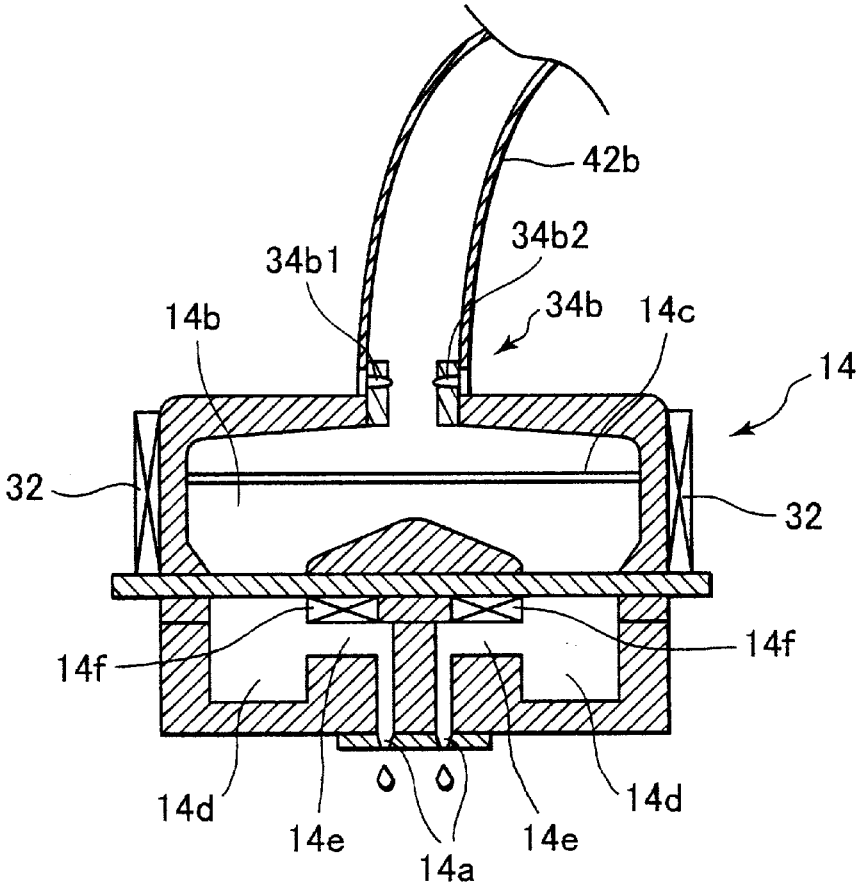
FIG. 13 is a cross-sectional view of a print head of the inkjet printer according to the third embodiment of the present invention.

As shown in FIGS. 11 to 13, the ink supply mechanism 120 includes an ink tank 40, an ink tube 42 connecting the ink tank 40 to the print head 14, a light propagation sensor 34*b*, and an ultrasonic vibrator 32. The ultrasonic vibrator 32 includes piezoelectric elements (not shown), and, as shown in FIG. 13, is provided on outer periphery of the ink head 14 to surround the ink chamber 14*b*. The light propagation sensor 34*b* serves as an ink state detector and includes a light emitting element 34*b*1 and a light receiving element 34*b*2 both provided inside the ink tube 42*b* near the print head 14. The light propagation sensor 34*b* detects a light propagation rate in ink.

The above described vibration application routine B is performed in the present embodiment. In this manner, the similar effect as the above-described second embodiment can be obtained in the present embodiment. That is, ultrasonic vibration generated by the ultrasonic vibrator 32 is applied to the ink inside the ink chamber 14*b*, so that any cohered or settled out pigments are dispersed throughout the ink. Also, because the ultrasonic vibrator 32 is provided to the print head 14, ultrasonic vibration is prevented from adversely affecting printing by avoiding generation of the ultrasonic vibration during the printing.

In addition, because the light propagation sensor 34*b* and the ultrasonic vibrator 32 are provided to the print head 14, the configuration of the ink supply mechanism 120 is made smaller than the ink supply mechanism 110 of the second embodiment. Further, because the ink tank 40 is directly supplied to the print head 14, the ink pump drive circuit 35, the ink pump 36, and the like can be omitted, so that the ink supply mechanism 120 can have less complex configuration than the ink supply mechanism 110.

Figure 14:
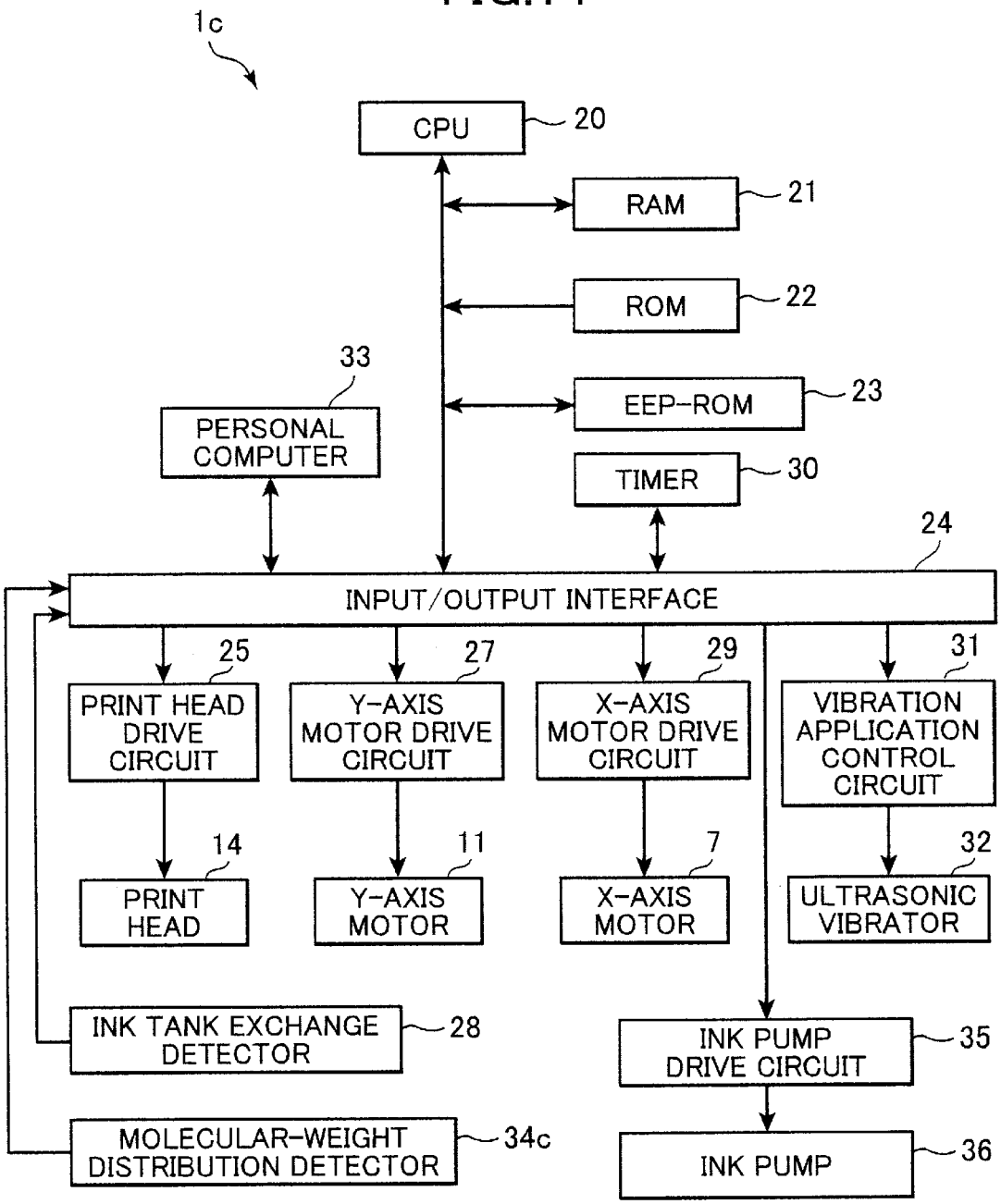
FIG. 14 is a block diagram showing electrical configuration of an inkjet printer according to a fourth embodiment of the present invention.

Next, an inkjet printer 1*c* according to a fourth embodiment of the present invention will be described with reference to FIGS. 14 to 16. The components similar to those of the first or second embodiment will be assigned with the same numberings and their explanation will be omitted.

Figure 15:
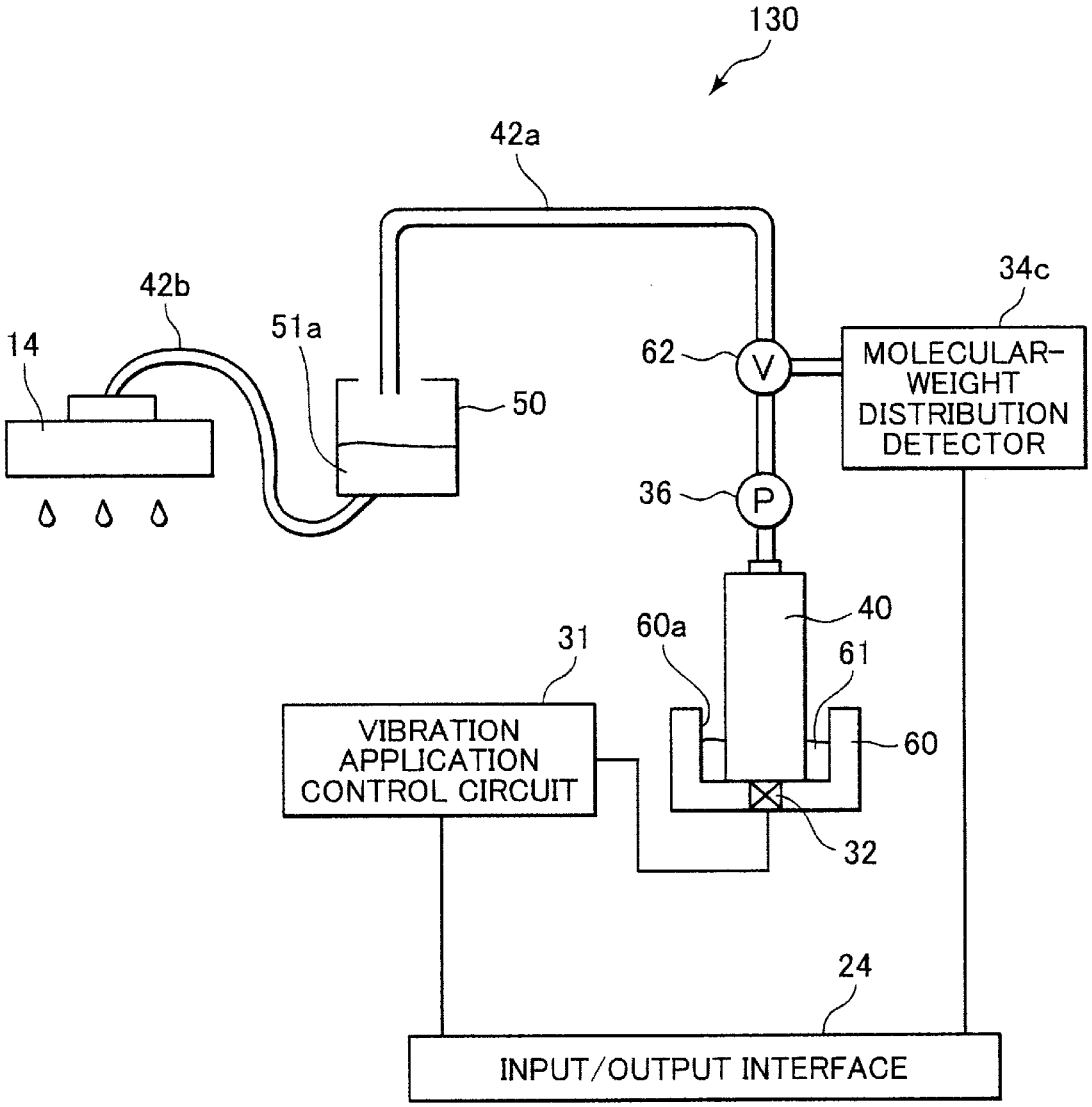
FIG. 15 is a schematic view of an ink supply mechanism of the inkjet printer according to the fourth embodiment of the present invention.
Figure 16:
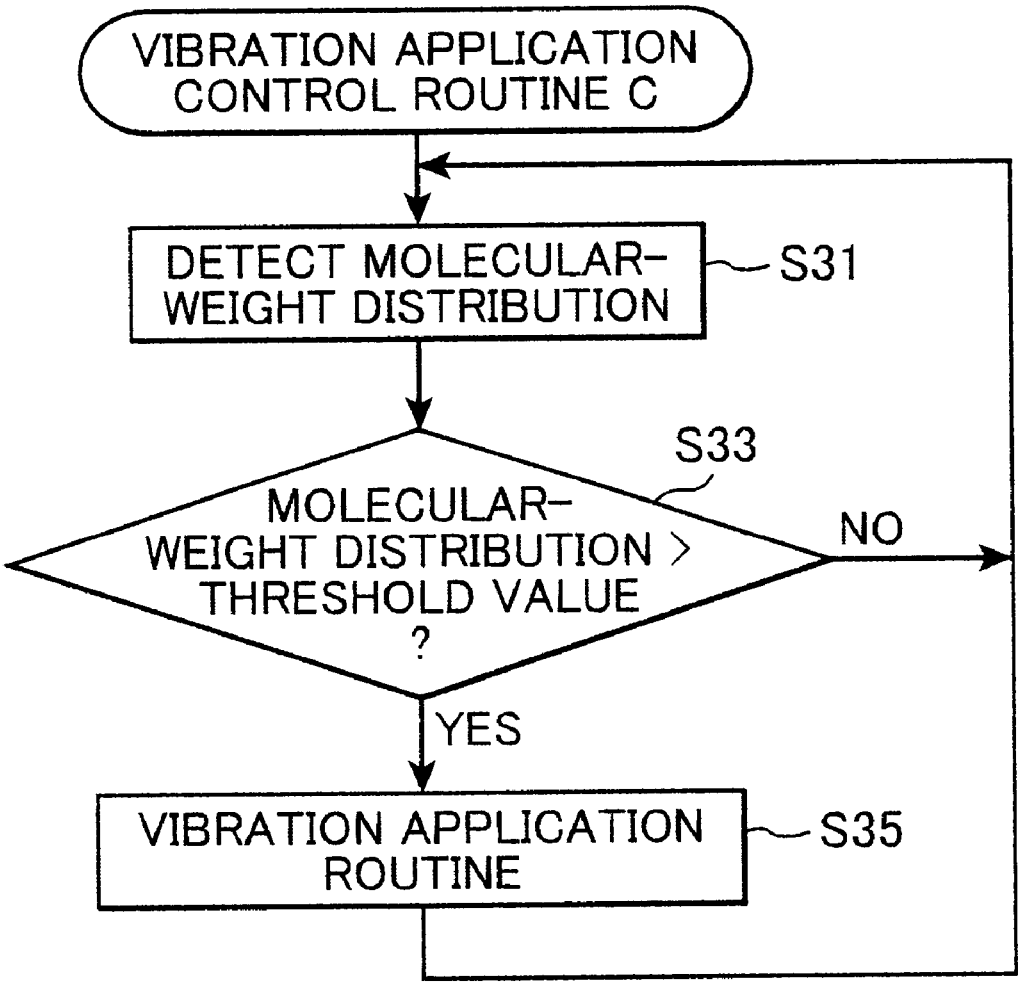
FIG. 16 is a flowchart representing a vibration application process C performed by the inkjet printer according to the fourth embodiment of the present invention.

The inkjet printer 1*c* is similar to the inkjet printer 1*a* of the second embodiment, except that the inkjet printer 1*c* includes an ink supply mechanism 130 shown in FIG. 15 instead of the ink supply mechanism 110. The ink supply mechanism 130 includes a vibration application control circuit 31, an ink tank 40, a sub tank 50, a molecular-weight distribution detector 34*c*, an ultrasonic vibrator 32, and a platform 60. An ink pump 36 and a switching valve 62 are connected to an ink tube 42*a* near the ink tank 40. Ink 51*a* is supplied from the ink tank 40 to the sub tank 50 through the ink tube 42*a* by operation of the ink pump 36, and is further supplied to the print head 14. The ink stored in the ink tank 40 is also supplied to the molecular-weight distribution detector 34*c*. In the present embodiment, a polymeric ink is used as the ink 51*a*.

The molecular-weight distribution detector 34*c* is connected to the switching valve 62. The molecular-weight distribution detector 34*c* serves as an ink state detector and is for detecting molecular-weight distribution in the polymeric ink. A well-know size exclusion chromatography (SEC) or a gel permeation chromatography (GPC) can be used as the molecular-weight distribution detector 34*c*.

The platform 60 is formed with an indentation in which the ink tank 40 is mounted. The ultrasonic vibrator 32 is embedded in the platform 60. The ultrasonic vibrator 32 can be a 500W to 1,000 W ultrasonic Langevin transducer as described above. The indentation 60*a* is filled with a liquid 61, such as water, so that ultrasonic vibration can be better transmitted to the ink in the ink tank 40. The vibration application control circuit 31 is connected to the molecular-weight distribution detector 34*c* through the input/output interface 24, and controls the ultrasonic vibrator 32.

Next, a vibration application control routine C performed according to the fourth embodiment will be described while referring to the flowchart in FIG. 16. First, in S31, the molecular-weight distribution detector 34*c* detects the molecular-weight distribution of the ink. Then, in S33, it is determined whether the detected molecular-weight distribution is greater than a predetermined threshold value. If not (S33:NO), this means that the molecular-weight distribution of the ink is normal. Then, the routine returns to S31.

On the other hand, if it is determined in S33 that the detected molecular-weight distribution is equal to or lower than the predetermined threshold value (S33:YES), this means that the molecular-weight distribution of the ink is not normal, so that a vibration application routine is executed in S35. In this vibration application routine, first the CPU 20 transmits a vibration application command to the vibration application control circuit 31. Then, the vibration application control circuit 31 in response controls the ultrasonic vibrator 32 to generate ultrasonic vibration at a frequency of several ten thousand kHz for about 10 minutes so as to apply the ultrasonic vibration to the ink in the ink tank 40. The ultrasonic vibration breaks molecular binding to reduce the molecular weight, so that the molecular-weight distribution of the ink reaches normal levels.

Here, the vibration application routine is executed in S15 and S35 in the first and fourth embodiments even if printing is being performed although in the second and third embodiments the vibration application routine is not executed as long as the printing is being performed. This is because the ink tank 40 of the first embodiment to which the ultrasonic vibrator 32 is attached is located away from the print head 14 and ultrasonic vibration will hardly be transmitted to the ink tank 40, and in the fourth embodiment the sub tank 50 located between the ink tank 40 to which the ultrasonic vibrator 32 and the print head 14 prevents ultrasonic vibration from being transmitted to the print head 14.

As described above, according to the present invention, ultrasonic vibration is applied to ink stored in ink reservoirs, such as an ink tank, a sub tank, to make the ink recover from unfavorable condition. Because the ultrasonic vibration can much more effectively sufficiently disperse pigments and polymeric materials in ink compared to merely stirring the ink, problems due to pigment sedimentation or the like can be reliably prevented according to the present invention.

While some exemplary embodiments of this invention have been described in detail, those skilled in the art will recognize that there are many possible modifications and variations which may be made in these exemplary embodiments while yet retaining many of the novel features and advantages of the invention.

For example, the present invention can be applied to a variety of different types of inkjet printer. The present invention is not limited to use in inkjet printers that use pigment-based ink or macromolecular ink, but can be applied to inkjet printers that use a variety of different types of ink. Also, the time that ultrasonic vibration is applied does not necessarily have to be for a period of 10 minutes. The inkjet device can be for office or industrial use. One example of polymeric ink is light-hardened resin liquefied using a solvent into ink that is used in inkjet printers for industrial use.

What is claimed is:

1. An inkjet device comprising:

an inkjet head that ejects ink droplets;

an ink reservoir that holds ink;

an ultrasonic vibration unit that applies ultrasonic vibration to the ink in the ink reservoir;

a condition judgment unit that judges whether an ink-deteriorating condition that may cause deterioration of ink is established; and a vibration control unit that, when the condition judgment unit judges that the ink-deteriorating condition is established, controls the ultrasonic vibration unit to apply the ultrasonic vibration to the ink.

2. The inkjet device according to claim 1, further comprising an ink state detector that detects change of the ink, wherein the condition judgment unit judges that the ink deteriorating condition is established when the ink state detector detects the change of the ink.

3. The inkjet device according to claim 2, wherein the ink state detector is a light propagation type sensor that detects a light propagation rate of the ink.

4. The inkjet device according to claim 2, wherein the ink state detector is a particle size distribution detector that detects particle size distribution of the ink.

5. The inkjet device according to claim 2, wherein the ink state detector is a molecular-weight distribution detector that detects molecular-weight distribution of the ink.

6. The inkjet device according to claim 1, further comprising a determination unit that determines whether or not the inkjet head is printing, the condition judgment unit judges that the ink-deteriorating condition is not established as long as the inkjet head is printing.

7. The inkjet device according to claim 1, further comprising an ink supply path through which the ink inside the ink reservoir is supplied to the inkjet head, wherein the ink reservoir is an ink tank.

8. The inkjet device according to claim 1, further comprising an ink tank, and an ink supply path that connects the ink tank to the inkjet head, wherein the ink reservoir is formed inside the inkjet head, and the ink is supplied from the ink tank to the ink reservoir through the ink supply path.

9. The inkjet device according to claim 1, further comprising an ink tank, a first ink supply path that connects the ink tank to the ink reservoir, a second ink supply path that connects the ink reservoir to the inkjet head, wherein the ink is supplied from the ink tank to the print head through the first ink supply path, the ink reservoir, and the second ink supply path.

10. The inkjet device according to claim 1, wherein the ultrasonic vibration unit includes an ultrasonic vibrator that generates the ultrasonic vibration and a liquid holding member that holds a liquid in which the ink reservoir is placed.

11. An inkjet device comprising:

an inkjet head that ejects ink droplets;

an ink reservoir that holds ink;

an ultrasonic vibration unit that applies ultrasonic vibration to the ink in the ink reservoir;

a timer that measures time from when the ultrasonic vibration unit most recently applied the ultrasonic vibration to the ink; and a vibration control unit that controls the ultrasonic vibration unit to apply the ultrasonic vibration to the ink when the timer measures a lapse of a certain duration of time.

12. The inkjet device according to claim 11, further comprising a determination unit that determines whether or not the inkjet head is printing, wherein the vibration control unit does not control the ultrasonic vibration unit as long as the inkjet head is printing.

13. An inkjet device comprising:

an ink jet head that ejects ink droplets;

an ink reservoir that holds ink;

an ultrasonic vibration unit that applies ultrasonic vibration to the ink in the ink reservoir;

an exchange detection unit that detects exchange of the ink reservoir; and a vibration control unit that controls the ultrasonic vibration unit to apply the ultrasonic vibration to the ink when the exchange detection unit detects exchange of the ink reservoir.

14. The inkjet device according to claim 13, further comprising an ink supply path through which the ink inside the ink reservoir is supplied to the inkjet head, wherein the ink reservoir is an ink tank.

15. The inkjet device according to claim 13, further comprising an ink tank, and an ink supply path that connects the ink tank to the inkjet head, wherein the ink reservoir is formed inside the inkjet head, and the ink is supplied from the ink tank to the ink reservoir through the ink supply path.

16. The inkjet device according to claim 13, further comprising an ink tank, a first ink supply path that connects the ink tank to the ink reservoir, a second ink supply path that connects the ink reservoir to the inkjet head, wherein the ink is supplied from the ink tank to the print head through the first ink supply path, the ink reservoir, and the second ink supply path.

* * * * *